US011215396B1

(12) United States Patent
Sanderson et al.

(10) Patent No.: US 11,215,396 B1
(45) Date of Patent: Jan. 4, 2022

(54) LAUNDRY SEPARATORS

(71) Applicants: Eliyahu Sanderson, Bay Harbor Islands, FL (US); Yisroel Brod, Surfside, FL (US); Tuvia Friedman, Surfside, FL (US)

(72) Inventors: Eliyahu Sanderson, Bay Harbor Islands, FL (US); Yisroel Brod, Surfside, FL (US); Tuvia Friedman, Surfside, FL (US)

( * ) Notice: Subject to any disclaimer, the term of this patent is extended or adjusted under 35 U.S.C. 154(b) by 133 days.

(21) Appl. No.: 16/817,346

(22) Filed: Mar. 12, 2020

(51) Int. Cl.
*F26B 1/00* (2006.01)
*D06F 58/20* (2006.01)

(52) U.S. Cl.
CPC ..... *F26B 1/00* (2013.01); *D06F 58/203* (2013.01)

(58) Field of Classification Search
CPC ..... D06F 58/203
See application file for complete search history.

(56) References Cited

U.S. PATENT DOCUMENTS 1,167,853 A * 1/1916 Stehlin ..... F26B 11/028 34/134
1,882,284 A * 10/1932 Hullings ..... B62B 3/104 68/143
2,443,419 A * 6/1948 Gould ..... D06F 58/04 34/109
4,467,535 A * 8/1984 Hardison ..... D06F 58/04 34/109
4,617,743 A * 10/1986 Barnard ..... F26B 25/14 34/109
5,365,675 A * 11/1994 Shabram, Jr. ..... D06F 58/04 34/109
5,398,428 A * 3/1995 Wallace ..... D06F 58/04 34/600

* cited by examiner

*Primary Examiner* — David J Laux

(57) ABSTRACT

Laundry separating devices that are configured to be inserted within a laundry drying chamber of a dryer machine are disclosed. The devices include a central frame having at least two sides with a first telescoping extender. The devices include at least two side arms connected to the central frame, with each side arm including a telescoping extender. The devices include a set of joints that connect the two side arms to the central frame, which allow each of the side arms to rotate about an axis. The devices include a set of telescopic clutches, with a clutch included in each of the central frame and the two side arms (the telescopic clutches are configured to allow the telescoping extenders to be lengthened, shortened, and locked into a desired position). The devices further include at set of separation panels, which are configured to be reversibly connected to the central frame and the two side arms.

6 Claims, 8 Drawing Sheets

LAUNDRY SEPARATORS

FIELD OF THE INVENTION

The field of the present invention relates to laundry dryer appliances and, more particularly, to devices for separating different types of laundry within a laundry dryer machine.

BACKGROUND OF THE INVENTION

Powered laundry dryers have been a household staple item for many decades, including both electric- and gas-powered dryers. Such dryers often include an internal chamber (typically a cylindrical chamber) that rotates and is provided with a continuous supply of (hot or room temperature) air to facilitate the drying of laundry. The size and internal volume capacities of such chambers vary, although standard capacities often range from about 7 cubic feet to 8.5 cubic feet (but can be smaller or larger in some cases).

Laundry dryers are routinely used to dry various types of laundry, ranging from clothes to bedding sheets (e.g., linens, comforters, etc.). When such disparate types and sizes of laundry are dried in a single load together, the larger items (e.g., bedding sheets) often become tangled with the smaller items (e.g., clothing items). Such tangling will sometimes compromise thorough drying; it increases the amount of undesired wrinkling; and it is burdensome on users to de-tangle and separate the laundry items after the drying cycle is complete.

Accordingly, there is a continuing need for laundry dryer appliances that are effective in preventing or reducing the amount of such unwanted tangling. The present invention, as described further below, addresses many of such demands in the marketplace.

SUMMARY OF THE INVENTION

According to certain aspects of the present invention, laundry separating devices are provided, which are configured to be inserted within a laundry drying chamber of a powered dryer machine. The devices include a central frame having four connected sides, with two sides of the four connected sides having a first telescoping extender. In addition, the devices include at least two side arms connected to the central frame, with a first side arm having two sides that include a second telescoping extender and a second side arm having two sides that include a third telescoping extender. According to such embodiments, the devices further include a set of joints (e.g., hinge joints) that connect the at least two side arms to the central frame, with the set of joints being configured to allow each of the two side arms to rotate about an axis.

Still further, the devices of the present invention include a set of telescopic clutches, with a least one clutch included in each of the central frame and the two side arms. The invention provides that the telescopic clutches are configured to allow the telescoping extenders to be selectively extended (lengthened), contracted (shortened), and locked into a desired position. In addition, the devices are equipped with a set of separation panels, which are configured to be reversibly connected to the central frame and the two side arms. The invention provides that each separation panel is preferably comprised of a porous material that is configured to permit sufficient air flow through the separation panel (to allow all laundry within the drying chamber to be thoroughly dried, when the separating devices of the present invention are disposed therein).

The invention provides that when the laundry separating devices are fittingly disposed within a laundry drying chamber of a powered dryer machine, the devices create separated drying sections within the laundry drying chamber. This way, larger and smaller laundry items may be separated and inserted into the different sections, which is effective to prevent the unwanted tangling described above. For example, large bedding items may be inserted into a first section, while smaller clothing items may be inserted into a second and/or third section created by a laundry separating device. The invention provides that the telescopic clutches—and the telescoping extenders—may be manually adjusted (lengthened or shortened) in a way such that the device makes contact with an inner surface of, and securely resides within, the laundry drying chamber. In addition, the invention provides that the set of joints mentioned above (which are configured to allow each of the at least two side arms to rotate about an axis) enable a user to adjust the size and volume capacity of each different drying section of the laundry drying chamber (as described further below).

The above-mentioned and additional features of the present invention are further illustrated in the Detailed Description contained herein.

DETAILED DESCRIPTION OF THE INVENTION

Figure 1:
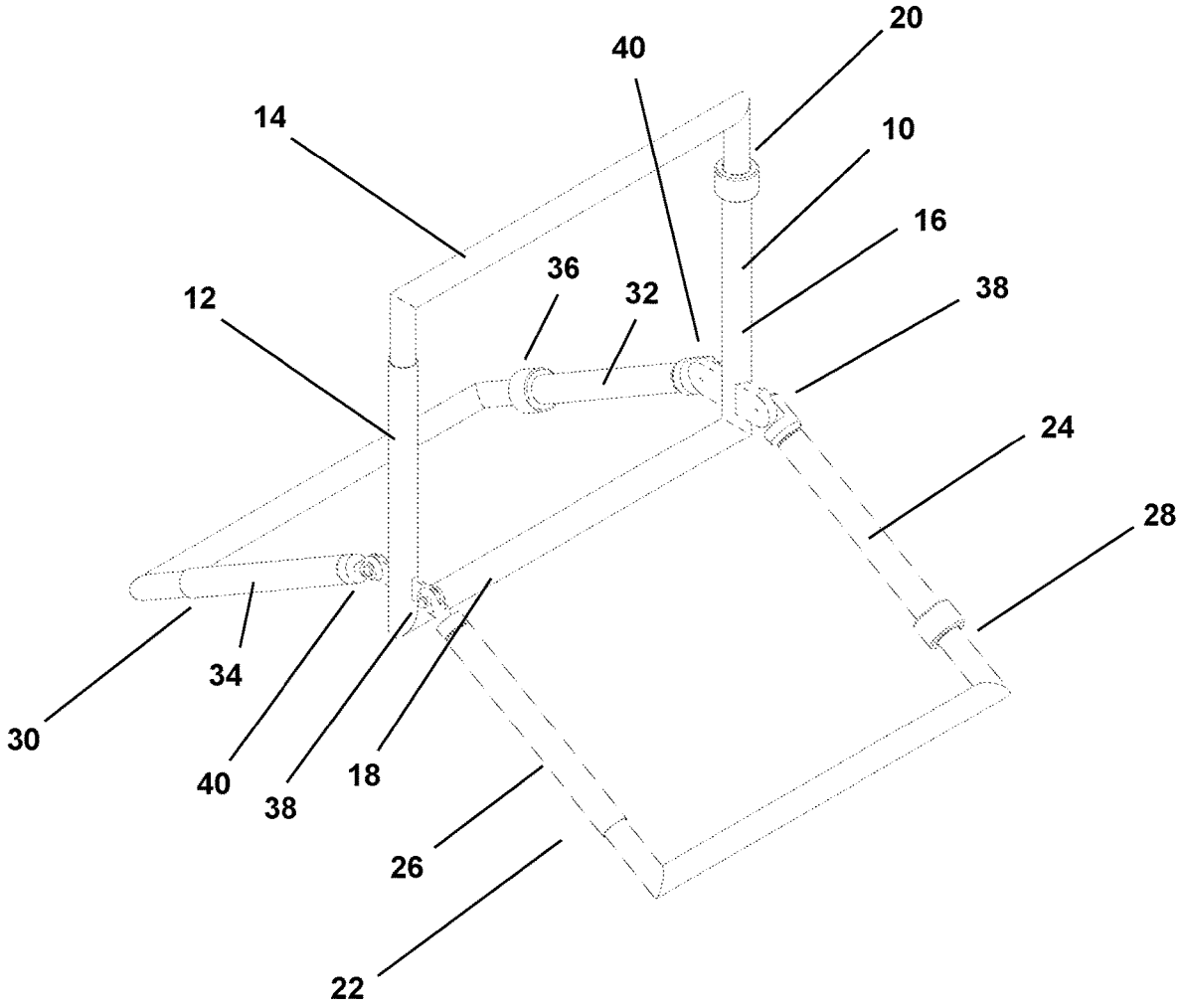
FIG. 1: a left elevated perspective view of a laundry separating device of the present invention.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to certain preferred embodiments of the present invention, laundry separating devices are provided, which are configured to be inserted within a laundry drying chamber of a powered dryer machine. Referring now to FIGS. 1-9, the devices include a central frame (10) having four connected sides (12, 14, 16, and 18), with two sides (12,16) of the four connected sides having a first telescoping extender (20). In addition, the devices include at least two side arms connected to the central frame (10), with a first side arm (22) having two sides (24,26) that include a second telescoping extender (28) and a second side arm (30) having two sides (32,34) that include a third telescoping extender (36). According to such preferred embodiments, the invention provides that the devices further include a set of joints (38,40)—e.g., hinge joints—that connect the at least two side arms (22,30) to the central frame (10), with the set of joints (38,40) being configured to allow each of the at least two side arms (22,30) to rotate about an axis.

Figure 5:
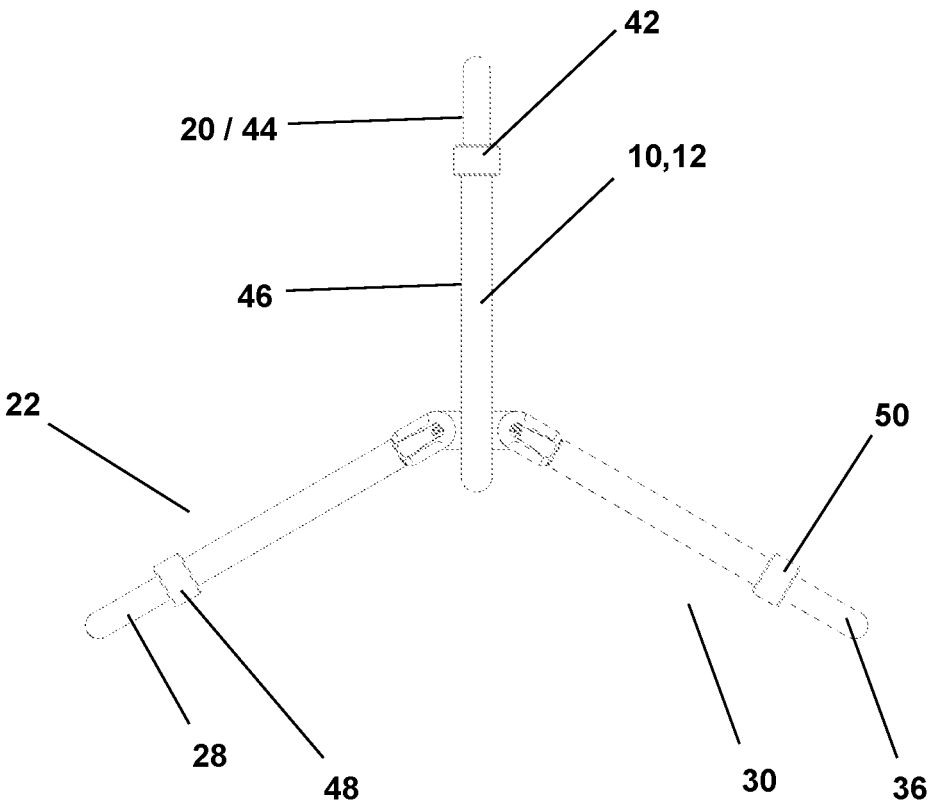
FIG. 5: a front view of the laundry separating device of FIG. 1.

Still further, and referring now to FIG. 5, the devices of the present invention include a set of telescopic clutches, with a least one clutch included in each of the central frame (10) and the at least two side arms (22,30). More specifically, the invention provides that the telescopic clutches are configured to allow the telescoping extenders (20,28,36) to be selectively extended (lengthened), contracted (shortened), and locked into a desired position. Still more specifically, for example, the central frame (10) will preferably include its own telescopic clutch (42), which is configured to be manually adjusted to allow the two sides (12,16) of the central frame (10) to be telescopically lengthened/extended or shortened/contracted. In such embodiments, a first part (44) of the two sides (12,16) comprises the telescoping extender (20), which is configured to be slidably and telescopically inserted into and pulled out of an interior area of a second part (46) of the two sides (12,16). This way, the two sides (12,16) may be telescopically lengthened or shortened, as desired, to accommodate the inner dimensions of a laundry drying chamber of a powered dryer machine. Similarly, as mentioned above, the invention provides that each of the two side arms (22,30) includes its own telescopic clutch (48,50), which is configured to be manually adjusted to allow the respective the telescoping extenders (28,36) to be manually and telescopically lengthened or shortened as desired.

As mentioned above, the telescopic clutches (42,48,50) may be manually loosened (or disengaged) to enable such telescopic movement of the extenders (20,28,36) and, once the two arms (22,30) exhibit the desired length, the telescopic clutches (42,48,50) may be manually tightened (or locked). The invention provides that the telescopic clutches (42,48,50) may be configured in various ways. For example, in some embodiments, the telescopic clutches (42,48,50) may be configured as a threaded sleeve that may be tightened by rotating the threaded sleeve along a set of corresponding grooves to a point that constricts and prohibits telescopic movement of the extenders (20,28,36) (and, of course, in such embodiments, the threaded sleeve may be rotated in an opposite direction to loosen the telescopic clutch (42,48,50), such that telescopic movement of the extenders (20,28,36) is enabled). In other embodiments, mechanical connectors may be used to lock the extenders (20,28,36) into a desired position. For example, the extenders (20,28,36) may include a series of apertures that exist along a side of the extenders (20,28,36), with the apertures being spaced apart over a certain distance and configured to reversibly receive a pin (when the target aperture is positioned adjacent to another aperture that resides within the telescopic clutch (42,48,50)) to lock the extenders (20,28, 36) into a particular location relative to the telescopic clutch (42,48,50).

Figure 2:
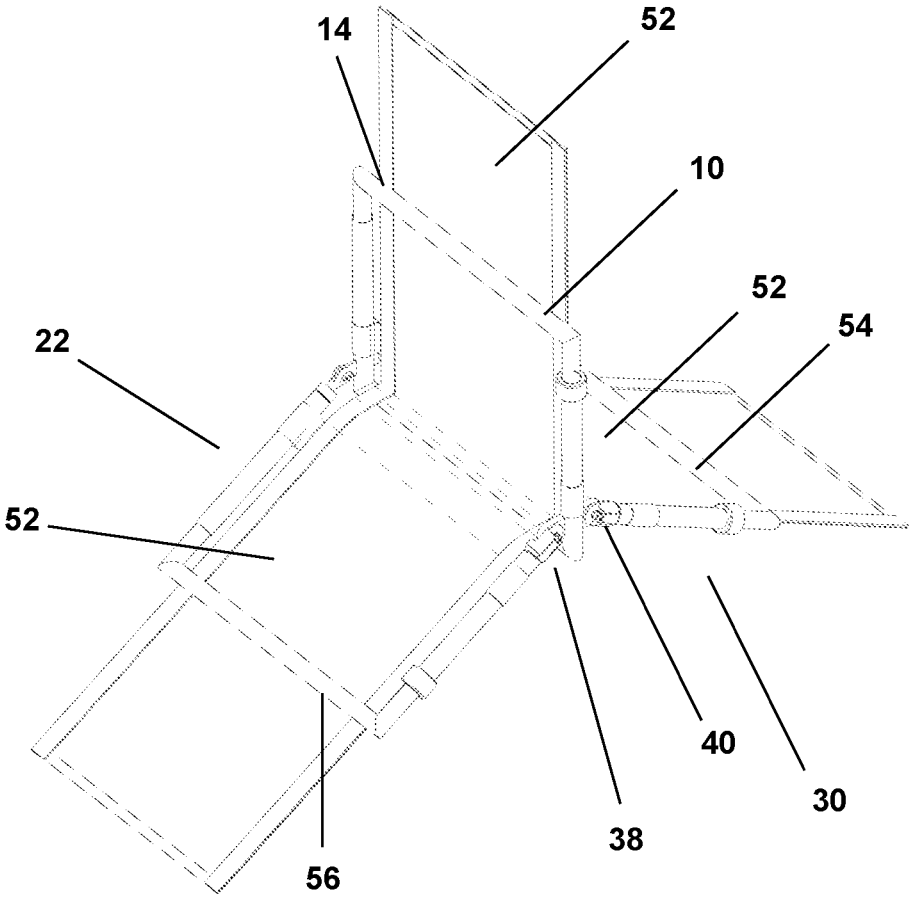
FIG. 2: a right elevated perspective view of the laundry separating device of FIG. 1, which includes a separation panel applied to the central frame and each arm of the device.
Figure 3:
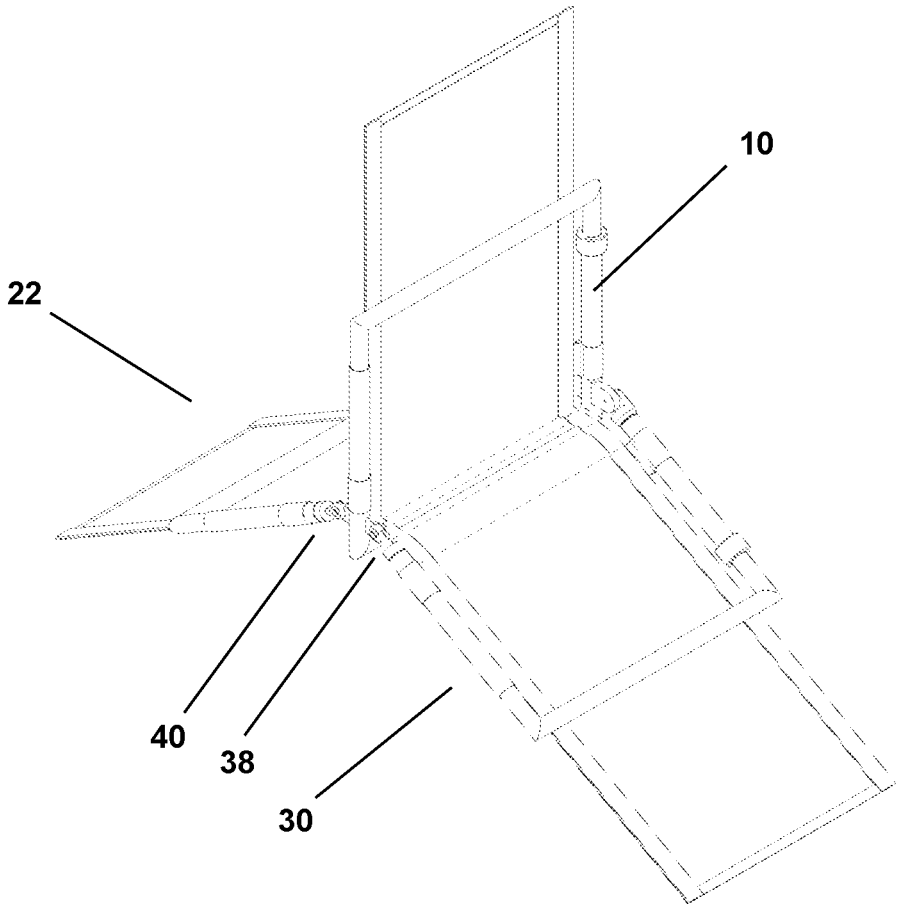
FIG. 3: a left elevated perspective view of the laundry separating device of FIG. 1, which includes a separation panel applied to the central frame and each arm of the device.
Figure 4:
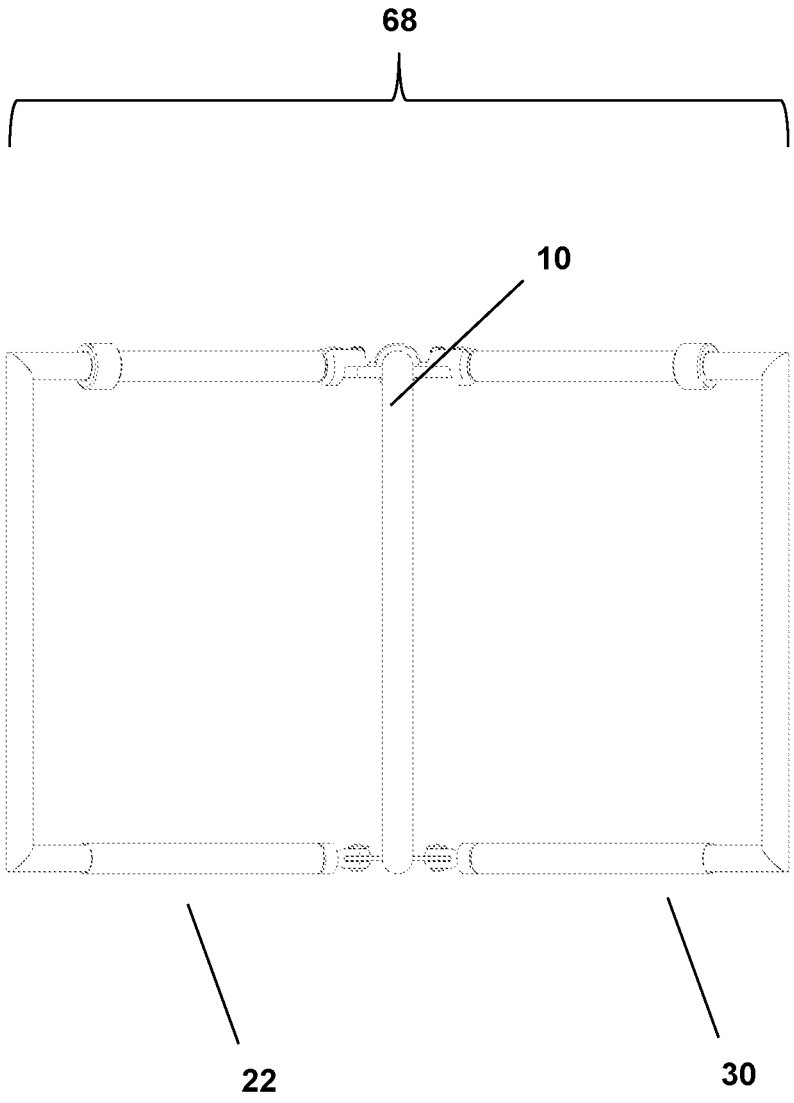
FIG. 4: a bottom view of the laundry separating device of FIG. 1.

Referring now to FIGS. 2 and 3, according to certain preferred embodiments of the present invention, the devices are further equipped with a set of separation panels (52), each of which are configured to be reversibly connected to the central frame (10) and the at least two side arms (22,30). The invention provides that each separation panel (52) is preferably comprised of a porous material that is configured to permit sufficient air flow through the separation panel (52)—to allow all laundry within the drying chamber to be thoroughly dried. For example, the separation panels (52) may be comprised of a mesh, netting, or other material through which air is allowed to easily travel (but which is sufficiently dense to retain smaller articles of laundry within a desired section of the laundry drying chamber, as explained further below).

The invention provides that the separation panels (52) may be applied to the device in various ways. For example, the separation panels (52) may be connected to the central frame (10) and the at least two side arms (22,30) using snaps, ties, or other mechanical attachment means—or, in some embodiments, through loop-and-hook materials. In the embodiments shown in FIGS. 2 and 3, the material that comprises the separation panels (52) extends beyond the ends of the central frame (10) and two side arms (22,30), such that the material may be folded over the sides (14,54, 56) and attached to itself through corresponding loop-and-hook materials.

Figure 9:
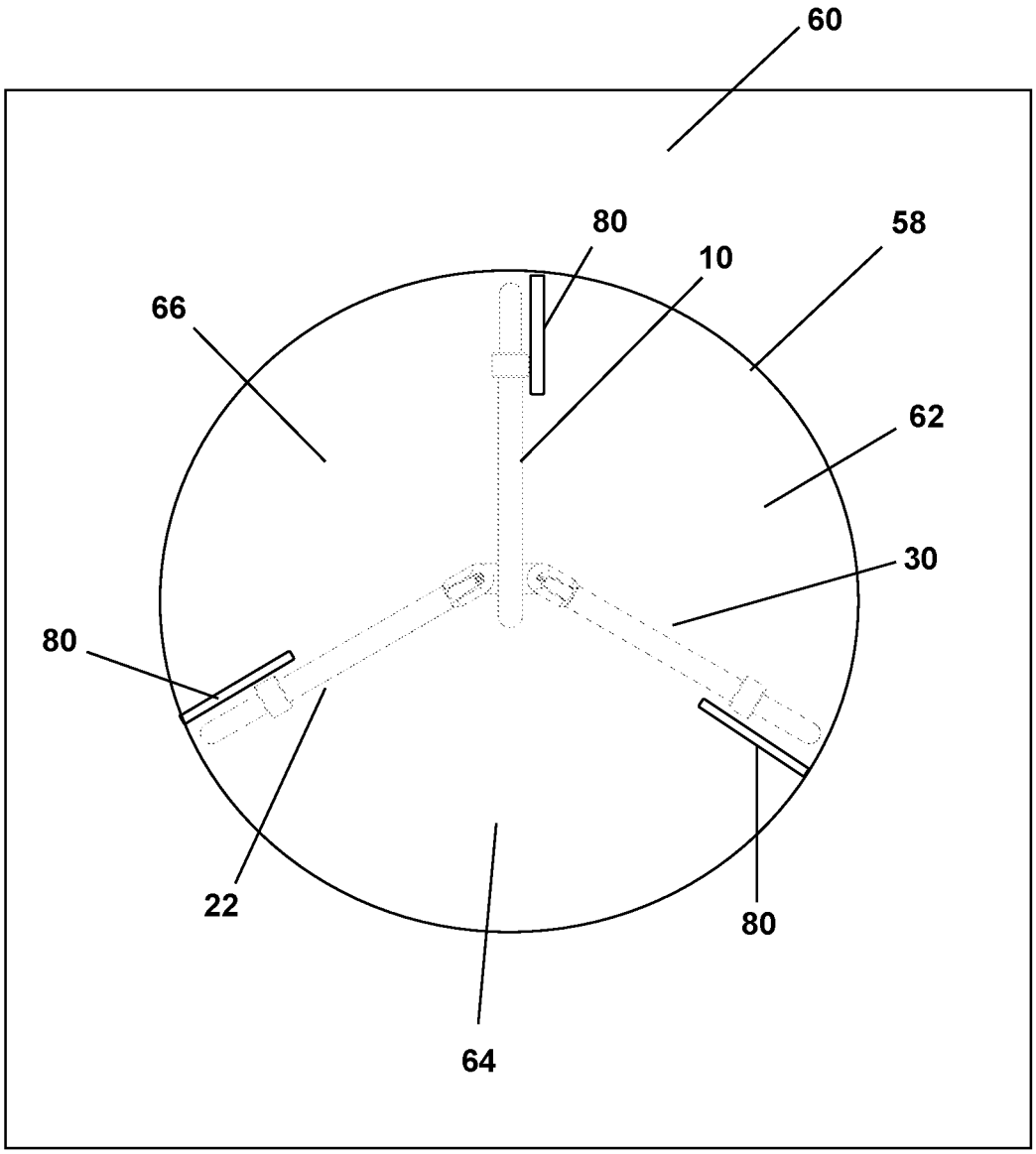
FIG. 9: a front view of the laundry separating device of FIG. 1 disposed within a laundry drying chamber of a powered dryer machine.

Referring now to FIG. 9, the invention provides that when the laundry separating devices are fittingly disposed within a laundry drying chamber (58) of a powered dryer machine (60), the devices create separated drying sections (62,64,66) within the laundry drying chamber (58). As such, larger and smaller laundry items may be separated and inserted into the different sections (62,64,66), which is effective to prevent the unwanted tangling of laundry items described above. For example, large bedding items may be inserted into a first section (62), while smaller clothing items may be inserted into a second and/or third section (64,66) created by the laundry separating device.

In addition, as mentioned above, since each separation panel (52) is configured to be reversibly attached to (and removed from) the central frame (10) and the at least two side arms (22,30), a user of the device (illustrated herein) may elect to attach 2 or 3 of the separation panels (52) to the device. More specifically, for example, by including three separation panels (52), the device produces three separate drying sections (62,64,66), as described above. If the user elects to only attach two of the separation panels (52), the device would produce two separate drying sections.

Figure 6:
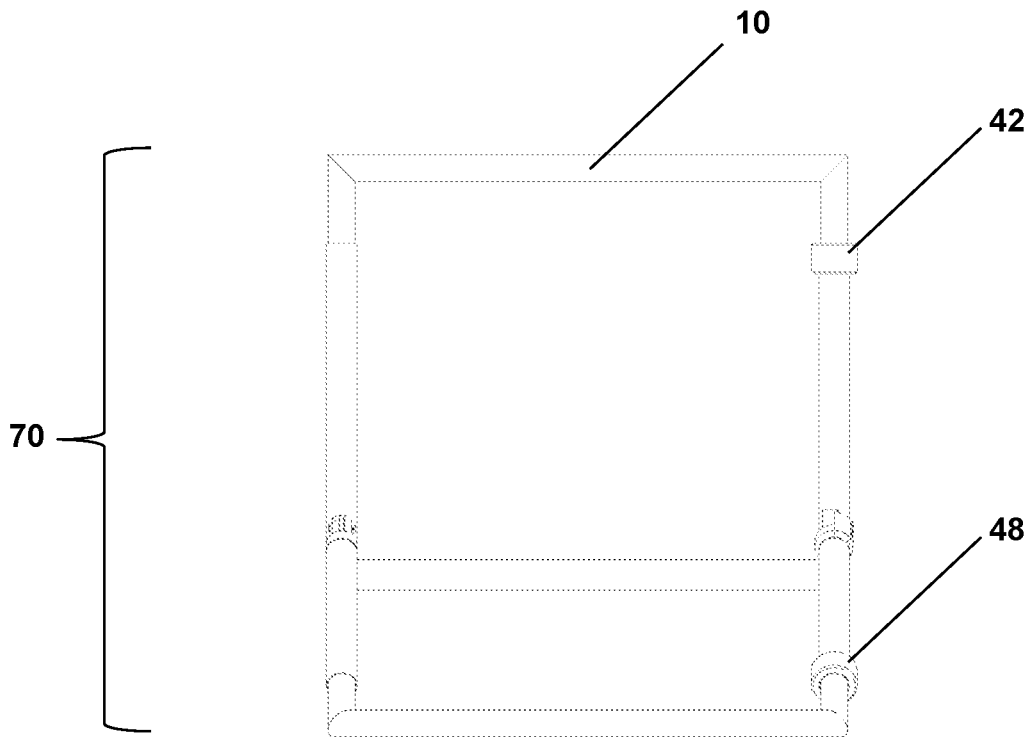
FIG. 6: a left view of the laundry separating device of FIG. 1.
Figure 7:
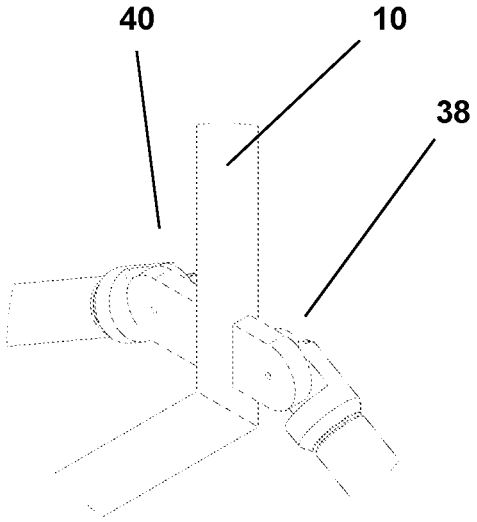
FIG. 7: an enlarged (interior) view of two moveable (hinge) joints that connect two arms to the central frame of the laundry separating device of FIG. 1.
Figure 8:
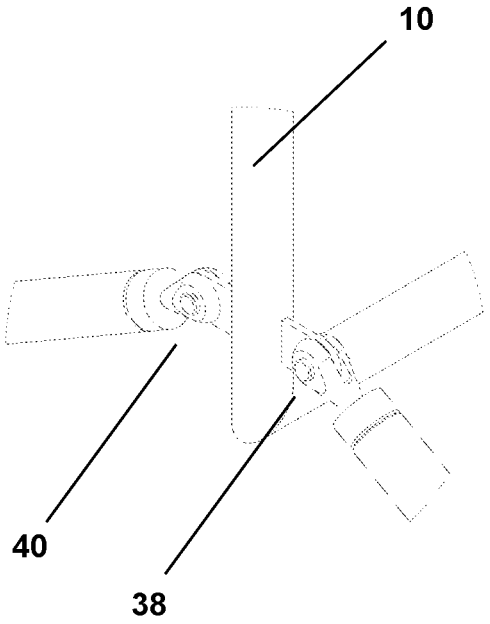
FIG. 8: an enlarged (exterior) view of two moveable (hinge) joints that connect two arms to the central frame of the laundry separating device of FIG. 1.

The invention provides that the laundry separating devices will preferably exhibit dimensions that will accommodate the inner dimensions of most full-size dryer machines. For example, in certain embodiments, the laundry separating devices may be about 25 inches in width (68) (FIG. 4) and about 19 inches in height (70)(FIG. 6). Importantly, however, the invention provides that the telescopic clutches (42,48,50)—and the telescoping extenders (20,28, 36)—may be manually adjusted (lengthened or shortened), as described herein, in a way such that the device makes secure contact with an inner surface of, and securely resides within, the laundry drying chamber (58)—i.e., such adjustable features allow the device to accommodate laundry drying chambers of different internal dimensions.

In addition, and as illustrated in FIG. 9, the laundry separating devices are preferably configured to be positioned and rest adjacent to the paddles (80) that are typically found within a laundry drying chamber (58). More specifically, the laundry separating devices are preferably positioned in a location that the laundry separating device is further supported by such paddles (80) during the rotation of a drying cycle. In the example shown in FIG. 9, if the laundry drying chamber (58) rotates in a counter-clockwise direction during a drying cycle, positioning the central frame (10) and two side arms (22,30) in the manner shown will allow the laundry separating device to leverage and be further supported by the paddles (80) during the rotation associated with a drying cycle.

In addition, the invention provides that the set of joints (38,40) mentioned above (which are configured to allow each of the at least two side arms (22,30) to rotate about an axis) enable a user to adjust the size/volume of each different drying section (62,64,66) of the laundry drying chamber (58). For example, referring to FIG. 9, by rotating the two side arms (22,30) towards the central frame (10), drying section (64) becomes larger, whereas drying sections (62,66) become proportionally smaller. Such features allow a user to select the desired volumes and laundry capacities of the different drying sections (62,64,66) created by the laundry separating device of the present invention.

Still further, according to certain additional embodiments of the invention, a frictional material may be applied to a distal end of the central frame (10) and the side arms (22,30), with the frictional material being configured to make contact with an internal surface of the laundry drying chamber (58). Such frictional material, e.g., certain types of elastomers and rubber materials, may further aid in securing the laundry separating devices within a laundry drying chamber (58). In addition, such frictional material may protect the internal surface of the laundry drying chamber (58) from unwanted scraping by the separator device of the present invention.

The invention provides that the laundry separating devices of the present invention may be comprised of various materials; provided, however, that such materials are sufficiently durable to withstand the high temperatures of powered dryers (and, furthermore, will not damage the laundry items with which the devices will make contact during a drying cycle). For example, the laundry separating devices of the present invention may be comprised of durable plastics, elastomers, metals, and/or combinations thereof. In addition, although the embodiments shown in FIGS. 1-9 illustrate the central frame (10) and two side arms (22,30) to exhibit a cylindrical configuration, the invention provides that such parts may, alternatively, exhibit other geometries. For example, the central frame (10) and two side arms (22,30) may be configured to exhibit a rectangular configuration, so long as the telescoping function of the telescopic clutches (42,48,50)—and the telescoping extenders (20,28,36)—is maintained.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A laundry separating device that is configured to be inserted within a laundry drying chamber of a powered dryer machine, which comprises:

(a) a central frame having four connected sides, with two sides of the four sides having a first telescoping extender;

(b) at least two side arms connected to the central frame, with a first side arm having two sides that include a second telescoping extender and a second side arm having two sides that include a third telescoping extender;

(c) a set of joints that connect the at least two side arms to the central frame, wherein the set of joints are configured to allow each of the at least two side arms to rotate about an axis;

(d) a set of telescopic clutches, with a least one clutch included in each of the central frame and the at least two side arms, wherein (i) a first telescopic clutch is configured to allow the first telescoping extender to be selectively lengthened, shortened, and locked into a desired position; (ii) a second telescopic clutch is configured to allow the second telescoping extender to be selectively lengthened, shortened, and locked into a desired position; and (iii) a third telescopic clutch is configured to allow the third telescoping extender to be selectively lengthened, shortened, and locked into a desired position; and (e) a set of separation panels, wherein the separation panels are configured to be reversibly connected to the central frame and the at least two side arms.

2. The laundry separating device of claim 1, wherein (a) each separation panel within the set of separation panels comprises a porous material that is configured to permit air flow through the separation panel and (b) each separation panel within the set of separation panels is configured to be independently attached to and removed from the device.

3. The laundry separating device of claim 1, which further comprises a frictional material that resides on a distal end of the central frame and a distal end of the at least two side arms, wherein the frictional material is configured to make contact with an inner surface of the laundry drying chamber.

4. The laundry separating device of claim 1, wherein each of the central frame and the at least two side arms exhibits a cylindrical configuration.

5. The laundry separating device of claim 1, wherein the device is comprised of heat-resistant plastics, metals, elastomers, or combinations thereof.

6. The laundry separating device of claim 1, wherein the device is configured to be positioned adjacent to, and to be supported by, a series of paddles included within the laundry drying chamber.

* * * * *